US007617638B1

(12) United States Patent
Slama et al.

(10) Patent No.: US 7,617,638 B1
(45) Date of Patent: Nov. 17, 2009

(54) SIDING SYSTEM

(76) Inventors: Peter D. Slama, 5858 Blackshire Path, Inver Grove Heights, MN (US) 55076; Bill Krech, 5858 Blackshire Path, Inver Grove Heights, MN (US) 55076; Greg Wallace, 5858 Blackshire Path, Inver Grove Heights, MN (US) 55076

( * ) Notice: Subject to any disclaimer, the term of this patent is extended or adjusted under 35 U.S.C. 154(b) by 184 days.

(21) Appl. No.: 11/758,882

(22) Filed: Jun. 6, 2007

(51) Int. Cl.
*E04B 7/00* (2006.01)

(52) U.S. Cl. ..... 52/95; 52/302.1; 52/302.3; 52/198; 52/199

(58) Field of Classification Search ..... 52/95, 52/302.1, 302.3, 198, 199, 551, 553; 428/17, 428/169

See application file for complete search history.

(56) References Cited

U.S. PATENT DOCUMENTS

| | | | | |
|---|---|---|---|---|
| 3,313,072 | A | 4/1967 | Cue | |
| 4,807,409 | A * | 2/1989 | Sells | 52/95 |
| 5,477,651 | A | 12/1995 | Fitzgibbon | |
| 5,487,247 | A | 1/1996 | Pigg | |
| 6,594,964 | B2 | 7/2003 | Charland | |
| 6,594,965 | B2 | 7/2003 | Coulton | |
| 6,620,040 | B2 | 9/2003 | Rehbein et al. | |
| 6,786,013 | B2 | 9/2004 | Coulton | |
| 6,792,725 | B1 | 9/2004 | Rutherford | |
| 6,938,383 | B2 * | 9/2005 | Morris et al. | 52/95 |
| 6,990,775 | B2 * | 1/2006 | Koester | 52/302.1 |
| 7,143,551 | B2 | 12/2006 | Corwin | |
| 2005/0160684 | A1 * | 7/2005 | Duncan | 52/95 |
| 2006/0117688 | A1 * | 6/2006 | Hauck | 52/302.1 |
| 2007/0113499 | A1 * | 5/2007 | Williams | 52/302.1 |
| 2007/0204541 | A1 * | 9/2007 | Sade | 52/302.1 |

* cited by examiner

*Primary Examiner*—Richard E Chilcot, Jr.
*Assistant Examiner*—Alp Akbasli

(57) ABSTRACT

A siding system for efficiently increasing the longevity of an outer wall structure (i.e. siding, etc.) of a building. The siding system generally includes a siding assembly which includes a venting structure including a first support member and a second support member, wherein the first support member is attached to the second support member. A plurality of first passageways and a plurality of second passageways extend between the first support member and the second support member, wherein a first perimeter of the plurality of first passageways varies from a second perimeter of the plurality of second passageways. The venting structure is positioned between a first layer and a second layer of an outer wall structure to allow the layers to efficiently dry and prevent moisture from building up between the layers.

19 Claims, 3 Drawing Sheets

SIDING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to siding assemblies and more specifically it relates to a siding system for efficiently increasing the longevity of an outer wall structure (i.e. siding, etc.) of a building.

2. Description of the Related Art

Any discussion of the prior art throughout the specification should in no way be considered as an admission that such prior art is widely known or forms part of common general knowledge in the field.

Siding has been in use for years. Typically, siding is utilized in the construction of a building to cover the outer wall structure and subsequently protect the outer wall structure from water and other weather elements. Siding may be manufactured from various materials, such as wood, plastic, metal or composite materials. Siding is also generally attached upon the outer surface of the outer wall structure, wherein the outer surface that the siding is attached to may be comprised of various configurations, such as a layer of sheathing (i.e. plywood/other planar material covering the wall studs) or wall studs.

When attaching the siding directly to the sheathing or the wall studs there may be a moisture buildup between the siding and the sheathing or wall studs. Over a period of time this moisture buildup may form into mold, which may result in the need to completely reside the building. This can be very costly and time consuming.

Prior art has revealed some attempts in creating an airspace between the siding and the wall studs to allow for the moisture buildup to dry out before forming into mold. Prior art structures that attempt to create an airspace within an outer wall structure may be inefficient for various reasons, such as difficulty in installing and inefficiency in drying the moisture buildup. Because of the general lack of efficiency and practicality in the prior art there is the need for a new and improved siding system for efficiently increasing the longevity of an outer wall structure (i.e. siding, etc.) of a building.

BRIEF SUMMARY OF THE INVENTION

The general purpose of the present invention is to provide a siding system that has many of the advantages of the siding assemblies mentioned heretofore. The invention generally relates to a siding assembly which includes a venting structure including a first support member and a second support member, wherein the first support member is attached to the second support member. A plurality of first passageways and a plurality of second passageways extend between the first support member and the second support member, wherein a first perimeter of the plurality of first passageways varies from a second perimeter of the plurality of second passageways.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a siding system for efficiently increasing the longevity of an outer wall structure (i.e. siding, etc.) of a building.

Another object is to provide a siding system that easily attaches to an outer wall structure of a building.

An additional object is to provide a siding system that efficiently prevents moisture from building up between the siding and the wall studs of a building.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
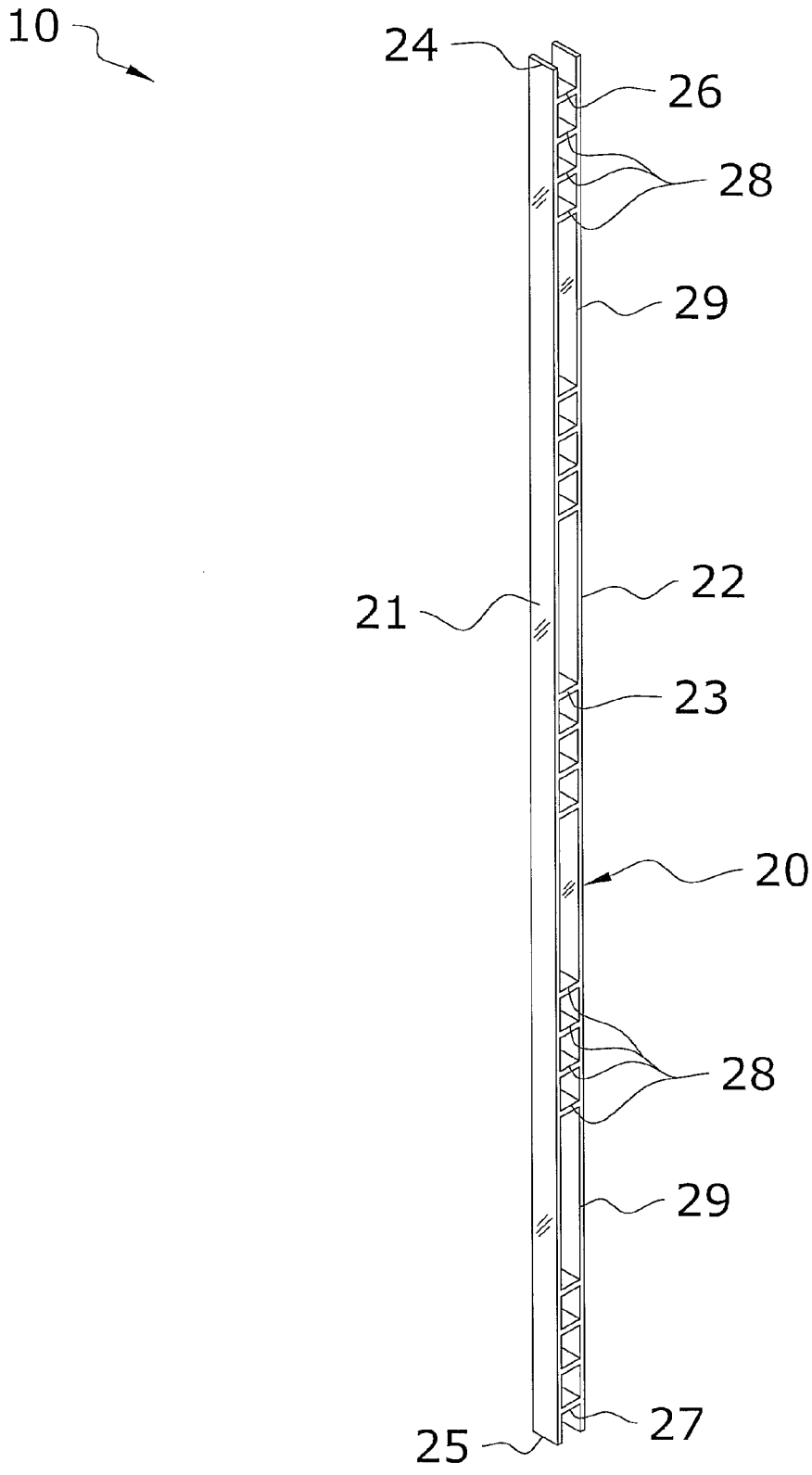
FIG. 1 is an upper perspective view of a preferred embodiment of the present invention.
Figure 2:
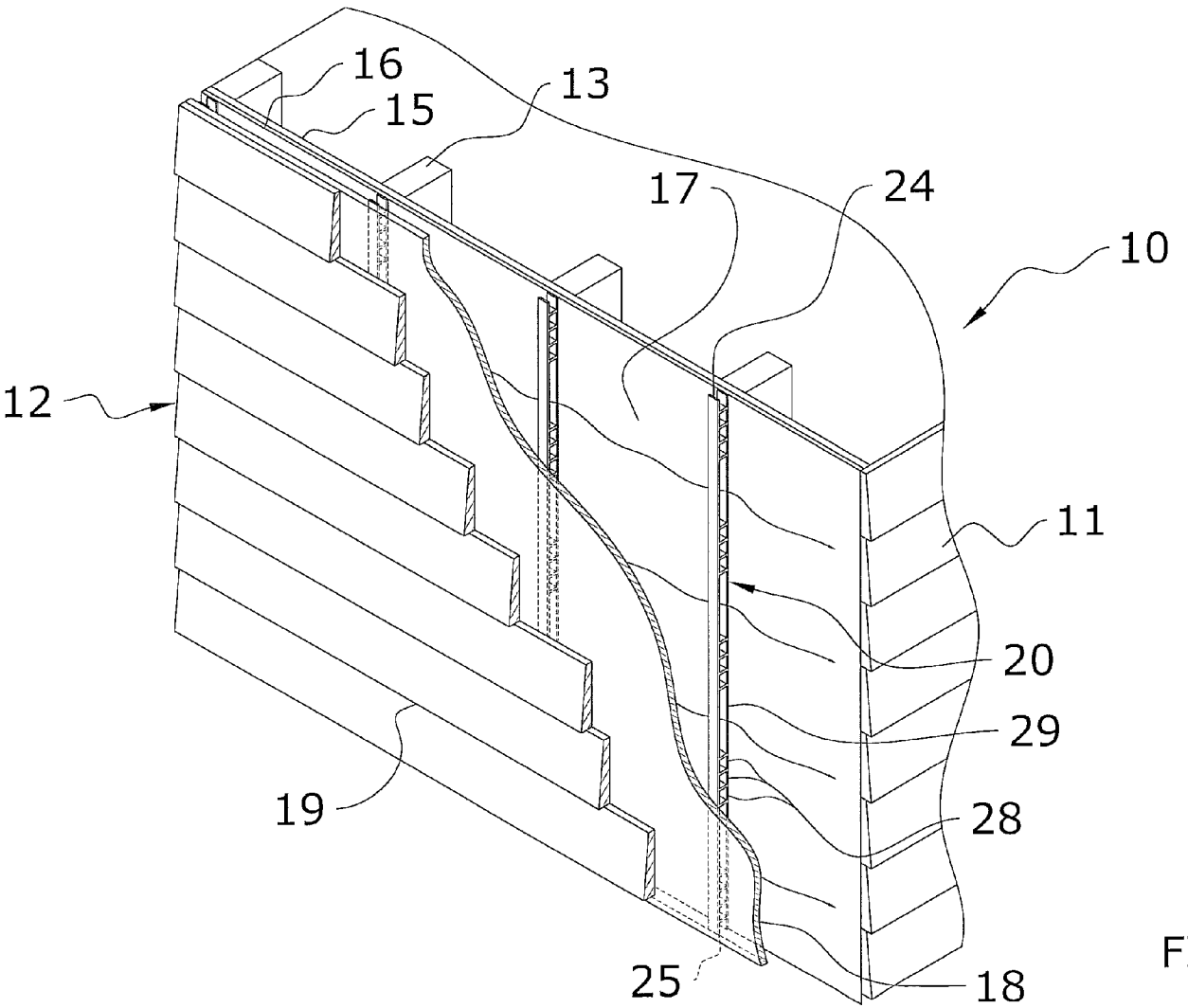
FIG. 2 is a cutaway upper perspective view of a preferred embodiment of the present invention in use.
Figure 3:
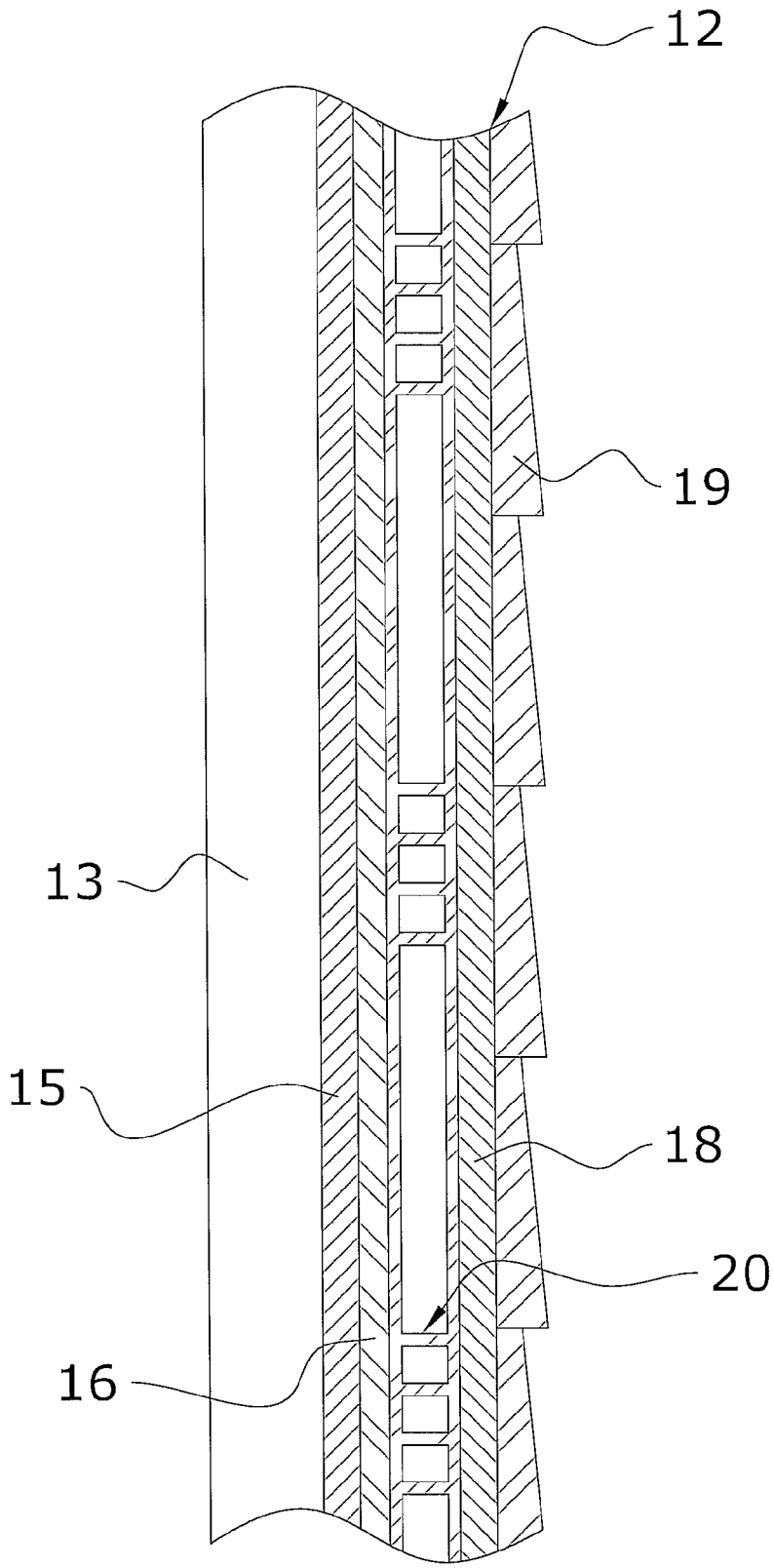
FIG. 3 is a cross-sectional view of a preferred embodiment of the present invention in use.

Turning now descriptively to the drawings, in which similar reference characters denote similar elements throughout the several views, FIGS. 1 through 3 illustrate a siding system 10, which comprises a venting structure 20 including a first support member 21 and a second support member 22, wherein the first support member 21 is attached to the second support member 22. A plurality of first passageways 28 and a plurality of second passageways 29 extend between the first support member 21 and the second support member 22, wherein a first perimeter of the plurality of first passageways 28 varies from a second perimeter of the plurality of second passageways 29. The venting structure 20 is positioned between a first layer and a second layer of an outer wall structure 12 to allow the layers to efficiently dry and prevent moisture from building 11 up between the layers.

B. Outer Wall Structure

The outer wall structure 12 of the building 11 utilized with the present invention may be comprised of various styles and configurations. The outer wall structure 12 may also include various materials and layers, some of which are described in the following description and some of which are not. It is appreciated that the present invention may be attached to various types of outer wall structures 12 all of which require a cavity 17 between two layers.

One configuration of the outer wall structure 12 is detailed in FIGS. 2 and 3 and also subsequently described. The outer wall structure 12 includes a first sheathing material 15 attached to a plurality of wall studs 13 and over the insulation between the wall studs 13.

A sheet of weather barrier 16 may also be positioned over the first sheathing material 15 opposite the wall studs 13. The present invention is subsequently attached to the outside of the weather barrier 16 opposite the first sheathing material 15. A second sheathing material 18 may also be attached to the present invention opposite the weather barrier 16 and the siding 19 may be attached to the second sheathing material 18 opposite the present invention.

It is appreciated that various layers (i.e. insulation, weather barrier 16, second sheathing material 18, etc.) may be omitted during construction of the outer wall structure 12 according to personal preferences and/or to adapt to various locations (i.e. cold climates, warm climates, etc.). The first sheathing material 15 and the second sheathing material 18 may also be comprised of various materials, such as but not limited to plywood and particle board. The wall studs 13, insulation, first sheathing material 15, weather barrier 16, second sheathing material 18 and siding 19 are further preferably comprised of materials common in the art of building 11 construction.

It is appreciated that in the preferred embodiment the present invention is positioned between the first sheathing material 15 and the siding 19. Various other materials (i.e. weather barrier 16, second sheathing material 18, etc.) may be positioned between the first sheathing material 15 and the present invention or the present invention and the siding 19.

It is also appreciated that in the following description the first sheathing material 15 and adjacent components (i.e. weather barrier 16, wall studs 13, insulation, etc.) will be referred to as a first layer and the siding 19 and adjacent components (i.e. second sheathing material 18, etc.) will be referred to as the second layer. It is further appreciated that the present invention may be attached between the first layer and the second layer in various manners, such as but not limited to with fasteners (i.e. screws, nails, etc.) or glue.

C. Venting Structure

The venting structure 20 utilized with the present invention creates a cavity 17 between the first layer and the second layer to allow the first layer and the second layer to keep dry and prevent moisture/mold from building 11 up between the first layer and the second layer. The cavity 17 formed by the present invention is also fluidly connected to various vents positioned upon upper and lower ends of the outer wall structure 12, wherein the cavity 17 is further fluidly connected with the outside air to better allow wind to circulate within the cavity 17.

The venting structure 20 may be comprised of various materials, such as but not limited to plastic. The venting structure 20 is comprised of a material that will withstand large amounts of weight and will not rot or wear away over when installed for several years or decades. The venting structure 20 is also preferably comprised of a rigid structure.

The venting structure 20 includes a first support member 21 and a second support member 22 as illustrated in FIGS. 1 through 3. The first support member 21 and the second support member 22 are attached via a plurality of connecting members 23 extending between the first support member 21 and the second support member 22.

The first support member 21 and the second support member 22 are parallel to each other and are also preferably comprised of planar configurations to efficiently attach between the first layer and the second layer. The first support member 21 and the second support member 22 are also preferably comprised of elongated configurations as illustrated in FIGS. 1 through 3. The elongated configurations allow the venting structure 20 to extend along a substantial height of the outer wall structure 12. In the preferred embodiment of the present invention the first support member 21 and the second support member 22 are comprised of 6 to 8 foot lengths.

The first support member 21 and the second support member 22 also extend from a first end 24 of the venting structure 20 to a second end 25 of the venting structure 20. The first end 24 is positioned upon an opposite longitudinal end of the venting structure 20 as the second end 25. The venting structure 20 also includes a first channel 26 extending through the first end 24 of the venting structure 20 and a second channel 27 extending through the second end 25 of the venting structure 20 as illustrated in FIGS. 1 through 3. The first channel 26 and the second channel 27 are preferably comprised of a U-shaped configuration.

The connecting members 23 attach the first support member 21 to the second support member 22 as illustrated in FIGS. 1 through 3. The connecting members 23 extend perpendicular to the first support member 21, the second support member 22 and the longitudinal axis of the venting structure 20. The spacing between the connecting members 23 is also preferably varied to allow for the differing size passageways extending between the first support member 21 and the second support member 22.

The first passageways 28 and the second passageways 29 extend between the first support member 21 and the second support member 22 as illustrated in FIGS. 1 through 3. The first passageways 28 and the second passageways 29 also preferably extend between the first channel 26 and the second channel 27 of the venting structure 20. The first passageways 28 and the second passageways 29 also interconnect with the cavity 17 and preferably extend perpendicular to the wall studs 13.

A first perimeter of the first passageways 28 is also different than a second perimeter of the second passageways 29 as illustrated in FIGS. 1 through 3. The differing perimeters preferably allow an increased circulation of air within the cavity 17 and through the first passageways 28 and the second passageways 29.

The first perimeter of the first passageways 28 is also preferably smaller than the second perimeter of the second passageways 29 as illustrated in FIGS. 1 through 3. The first passageways 28 further preferably outnumber the second passageways 29, wherein a group of first passageways 28 are positioned between each second passageway 29. In the preferred embodiment of the present invention the first passageways 28 are positioned adjacent to the first channel 26 and the second channel 27; however it is appreciated that the second passageways 29 may be positioned adjacent to the first channel 26 and the second channel 27.

D. Installation of Preferred Embodiment

In use, the first layer of the outer wall structure 12 is assembled and securely attached. The first support member 21 is now positioned adjacent the first layer and is centrally aligned with the wall stud 13. The venting structure 20 is now attached to the wall stud 13 by extending a fastener (i.e. screw, nail, etc.) through the venting structure 20 and into the wall stud 13 of the first layer. A venting structure 20 is subsequently preferably attached upon the first layer at each wall stud 13 along the outer wall structure 12.

The second layer may now be positioned against the second support member 22 of the venting structure 20 and subsequently attached to the first layer. The first support member 21 and the second support member 22 are also parallel to the first layer and the second layer. It is appreciated that the venting structure 20 may be attached between the first layer and the second layer in various methods rather than the described method.

E. Operation of Preferred Embodiment

In use, air is able to circulate between the first layer and the second layer via traveling through vents upon upper or lower ends of the outer wall structure 12 and through the cavity 17 between the first layer and the second layer. The cavity 17 is interconnected between each venting structure 20 via the plurality of first passageways 28 and second passageways 29.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A siding system, comprising:

an outer wall structure including an inner layer and a siding layer;

a venting structure attached between said inner layer and said siding layer;

wherein said venting structure includes a first support member and a second support member, wherein said first support member is attached to said second support member;

wherein a plurality of first horizontal passageways and a plurality of second horizontal passageways extend between said first support member and said second support member;

wherein a first perimeter of said plurality of first horizontal passageways varies from a second perimeter of said plurality of second horizontal passageways;

a first vertical passageway defined between said inner layer and said siding layer, wherein said first vertical passageway is fluidly connected to each of said plurality of first horizontal passageways and each of said plurality of second horizontal passageways;

wherein said first vertical passageway extends from a first side of said venting structure; and a second vertical passageway defined between said inner layer and said siding layer, wherein said second vertical passageway is fluidly connected to each of said plurality of first horizontal passageways and each of said plurality of second horizontal passageways;

wherein said second vertical passageway extends from a second side of said venting structure;

wherein said first side of said venting structure is opposite said second side of said venting structure.

2. The siding system of claim 1, wherein said first perimeter of said plurality of first horizontal passageways is smaller than said second perimeter of said plurality of second horizontal passageways.

3. The siding system of claim 2, wherein said plurality of first horizontal passageways outnumber said plurality of second horizontal passageways.

4. The siding system of claim 1, wherein said plurality of first horizontal passageways and said plurality of second horizontal passageways extend transversely between said first support member and said second support member.

5. The siding system of claim 1, wherein said first support member and said second support member are comprised of elongated configurations.

6. The siding system of claim 1, wherein said first support member is substantially parallel to said second support member.

7. The siding system of claim 1, wherein said venting structure includes a plurality of connecting members extending between said first support member and said second support member.

8. The siding system of claim 7, wherein said plurality of connecting members separate said plurality of first horizontal passageways from said plurality of second horizontal passageways.

9. The siding system of claim 7, wherein said plurality of connecting members are substantially perpendicular to said first support member and said second support member.

10. The siding system of claim 1, wherein said plurality of second horizontal passageways are positioned between said plurality of first horizontal passageways.

11. The siding system of claim 1, wherein a group of first horizontal passageways of said plurality of first horizontal passageways are positioned between each of said plurality of second horizontal passageways.

12. The siding system of claim 1, wherein a group of first horizontal passageways of said plurality of first horizontal passageways are positioned between each of said plurality of second horizontal passageways along a longitudinal axis of said venting structure.

13. The siding system of claim 1, wherein said venting structure is comprised of a rigid structure.

14. The siding system of claim 1, wherein said venting structure includes a first end and a second end opposite said first end, wherein said first support member and said second support member extend from said first end to said second end.

15. The siding system of claim 14, wherein said venting structure includes a first channel extending through said first end and a second channel extending through said second end, wherein said plurality of first horizontal passageways and said plurality of second horizontal passages are positioned between said first channel and said second channel.

16. A siding system, comprising:

an outer wall structure including an inner layer and a siding layer;

a venting structure attached between said inner layer and said siding layer;

wherein said venting structure includes a first support member and a second support member, wherein said first support member is attached to said second support member;

wherein a plurality of first horizontal passageways and a plurality of second horizontal passageways extend between said first support member and said second support member;

wherein a first perimeter of said plurality of first horizontal passageways varies from a second perimeter of said plurality of second horizontal passageways;

wherein said first perimeter of said plurality of first horizontal passageways is smaller than said second perimeter of said plurality of second horizontal passageways;

wherein said plurality of first horizontal passageways outnumber said plurality of second horizontal passageways;

a first vertical passageway defined between said inner layer and said siding layer, wherein said first vertical passageway is fluidly connected to each of said plurality of first horizontal passageways and each of said plurality of second horizontal passageways;

wherein said first vertical passageway extends from a first side of said venting structure; and a second vertical passageway defined between said inner layer and said siding layer, wherein said second vertical passageway is fluidly connected to each of said plurality of first horizontal passageways and each of said plurality of second horizontal passageways;

wherein said second vertical passageway extends from a second side of said venting structure;

wherein said first side of said venting structure is opposite said second side of said venting structure.

17. The siding system of claim 16, wherein said plurality of second horizontal passageways are positioned between said plurality of first horizontal passageways.

18. The siding system of claim 17, wherein a group of first horizontal passageways of said plurality of first horizontal passageways are positioned between each of said plurality of second horizontal passageways.

19. A siding system, comprising:

an outer wall structure including an inner layer and a siding layer;

a plurality of venting structures attached between said inner layer and said siding layer, wherein said plurality of venting structures are vertically offset from each other;

wherein said plurality of venting structures are each vertically oriented;

wherein said plurality of venting structures includes a first support member and a second support member, wherein said first support member is attached to said second support member;

wherein each of said plurality of venting structures include a plurality of connecting members attached orthogonally between said first support member and said second support member;

wherein a plurality of first horizontal passageways and a plurality of second horizontal passageways are defined by said plurality of connecting members;

wherein a first perimeter of said plurality of first horizontal passageways varies from a second perimeter of said plurality of second horizontal passageways;

wherein said plurality of first horizontal passageways have a smaller cross sectional area than said plurality of second horizontal passageways;

a plurality of vertical passageways defined between said inner layer and said siding layer, wherein said plurality of vertical passageways are fluidly connected to each of said plurality of first horizontal passageways and each of said plurality of second horizontal passageways;

wherein said plurality of vertical passageways are each separated by at least one of said plurality of venting structures;

wherein a group of first horizontal passageways of said plurality of first horizontal passageways are positioned between each of said plurality of second horizontal passageways;

wherein said first support member and said second support member are comprised of elongated configurations;

wherein said first support member is substantially parallel to said second support member.

* * * * *